US006848562B2

(12) United States Patent
Viola

(10) Patent No.: US 6,848,562 B2
(45) Date of Patent: Feb. 1, 2005

(54) DEVICE FOR REMOVAL OF CONTROLLER ASSEMBLY FROM ESCALATOR PIT

(76) Inventor: Barry Jay Viola, 3362 51st Rd., Arkansas City, KS (US) 67005

( * ) Notice: Subject to any disclaimer, the term of this patent is extended or adjusted under 35 U.S.C. 154(b) by 11 days.

(21) Appl. No.: 10/445,158

(22) Filed: May 27, 2003

(65) Prior Publication Data

US 2004/0238322 A1 Dec. 2, 2004

(51) Int. Cl.[7] ..... B66B 21/00
(52) U.S. Cl. ..... 198/321; 198/322; 198/330
(58) Field of Search ..... 198/321, 322, 198/330

(56) References Cited

U.S. PATENT DOCUMENTS 4,360,078 A * 11/1982 Schoneweiss ..... 198/321
5,135,097 A * 8/1992 Saito et al. ..... 198/330
5,697,485 A * 12/1997 Abraham et al. ..... 198/322
6,049,189 A * 4/2000 Markus et al. ..... 318/802
6,267,219 B1 * 7/2001 Spannhake et al. ..... 198/323
6,626,279 B2 * 9/2003 Henkel et al. ..... 198/322

FOREIGN PATENT DOCUMENTS

JP 11-157769 * 11/1997 ..... 198/321

* cited by examiner

*Primary Examiner*—Douglas Hess

(57) ABSTRACT

In accordance with the present invention, there is a need for removal of the controller assembly from its stored location within the escalator pit for the purpose of working on the escalator or the escalator controller itself. The risk for human injury associated with this removal can be eliminated through the use of the present invention, that of a power driven ejection device for the automatic removal of the escalator controller from the escalator pit, with the main components of the automatic ejection device being the mounting base/guide tube, the drive system, the carriage, the main attachment pin and the controller attachment bracket, the automatic pivoter and the optional latch and manual release.

5 Claims, 4 Drawing Sheets

DEVICE FOR REMOVAL OF CONTROLLER ASSEMBLY FROM ESCALATOR PIT

CROSS REFERENCE TO RELATED APPLICATIONS

None

FEDERALLY SPONSORED RESEARCH

There is no Federally sponsored research associated with this application.

REFERENCE TO SEQUENCE LISTING

None

FIELD OF THE INVENTION

The present invention relates to escalator controller assemblies and, more particularly, to the removal of the controller assembly from the escalator pit.

BACKGROUND OF THE INVENTION

Escalators, also known as moving stairs, and when horizontal moving walks, are a useful aid in moving people from one elevation to another. An escalator is composed of two endless chains to which steps are attached. These chains travel from the lowest elevation of the escalator up to the highest elevation, around a set of sprockets, back to the bottom and around another set of sprockets where they endlessly repeat the journey. It is these chains to which the steps attach, linked one after another that provide for the moving stairs that people ride. In order to contain, support and conceal the mechanisms and apparatus of an escalator, a structural truss is provided. This truss is the main skeleton of the escalator and is concealed beneath the portion that is ridden. At each end of the truss is a pit, with there being two pits, an upper and a lower. The upper pit, located at the upper elevation, contains the escalator driving system along with the controller assembly, which is composed of a multitude of electrical components such as relays and transformers, all contained in an enclosure, with the total weight of this controller assembly being in excess of what is safe for a human to lift without the chance of injury.

This upper pit is contained underneath the portion of the escalator called the floor plate. The floor plate is the stationary floor area at each egress of the escalator. These floor plates are removable to provide access to the pit below. Because of space constrictions it is required to remove the controller assembly from the escalator pit to perform work on it, and as such, controller assemblies are constructed with flexible cables to allow their removal from the pit. This removal process is done manually by the service technician performing work on the escalator. Because the controller assembly is located beneath the technician, the technician is forced to bend over putting them and their back in a weakened position. This combined with the weight of the controller assembly poses a dangerous situation that can easily result in injury. There are no solutions in existence. Manufacturers have provided handles on top of the controller assembly enclosure as an aid in gripping the controller assembly for manual removal, but no actual device to replace human effort has been provided.

It is therefore an object of this invention to provide a means for removal of an escalator controller assembly from an escalator pit that will eliminate the need for manual removal, thereby eliminating the potential for human injury.

It is another object of this invention to provide a means for removal of an escalator controller assembly from an escalator pit, thereby eliminating the possibility of damage to the escalator components such as flexible control cables, drives and other components that may be damaged by human entry into the pit for the purpose of controller assembly removal.

It is another object of this invention to provide a means for removal of an escalator controller assembly from an escalator pit, eliminating the chance for human injury that may happen from entering into the pit for the purpose of controller assembly removal.

It is another object of this invention to provide a means for removal of an escalator controller assembly from an escalator pit, thereby eliminating the need for human contact with the controller assembly and the chance for damage to the controller assembly possibly caused by dropping or hitting the controller while removing it.

It is another object of this invention to provide a means for removal of an escalator controller assembly from an escalator pit, thereby eliminating the need for human contact with the controller assembly and the potential for human injury that could be incurred due to dropping the controller on an appendage.

It is another object of this invention to provide a means for removal of an escalator controller assembly from an escalator pit, thereby providing a physical means to attach the flexible control cables to, to prevent their snagging and dislodging from the controller during removal.

BRIEF SUMMARY OF THE INVENTION

In accordance with the present invention, there is a need for removal of the controller assembly from its stored location within the escalator pit for the purpose of working on the escalator or controller assembly itself Due to the tight space restrictions within the escalator pit it is necessary to remove the controller assembly prior to working on the escalator or controller assembly. As such, controller assemblies for escalators are designed to be removed from the pit and placed upon the floor where access can then be gained to the pit, or the controller assembly itself.

Escalator controller assemblies are of sufficient weight as to cause human injury when attempting to remove them from the pit. This weight combined with their stored location being below floor level pose an unnecessary risk for injury, which can be eliminated with the use of the present invention, that of a power driven ejection device for the automatic removal of an escalator controller assembly from the escalator pit.

The main components of this ejection device are the drive, the base/guide, the carriage, the attachment linkage, the optional automatic pivoter and the optional latch with manual release.

The drive shown is that of an electric gear motor driving a shaft, upon which, chain type driving sprockets are mounted. These driving sprockets convert the rotary motion of the gear motor into the linear motion of the drive chains. The drive chains travel approximately the height of the pit where they travel around sprockets and return, with the ends of the drive chains attached to the ejector carriage. In this way the carriage travels vertically upward to eject the controller assembly and vertically downward to replace the controller assembly. The drive shown, that of an electric gear motor, is intended as a sample representation only. Any means of power assistance such as hydraulics, pneumatics, screw drives, or other means of stored energy such as springs or counterweights, means of mechanical advantage such as linkages and levers, or other devices to provide aid and assistance in the ejection of the controller assembly may be used.

The base/guide provides the central mounting points for the components of the automatic ejector. The base is attached to the escalator truss as a means of support. The base provides mounting for the drive system as well as providing a guide for the carriage to travel on as it moves up and down. The base/guide shown is a typical representation and is not intended to be limiting to one form alone. Other guides such as cables, threaded rod or other means may be used.

The carriage is contained around the guide tube and is free to move up and down as driven by the drive chains. As the drive motor receives its signal, the drive shaft and sprockets rotate causing the chains and carriage to travel in the desired direction. Through a rotating attachment pin the carriage is attached to the controller assembly, thereby providing for the point of interface between the automatic ejector and the controller assembly. This attachment pin allows the carriage to raise or lower the controller assembly along with it thereby either raising and ejecting the controller assembly from the pit or lowering and replacing the controller assembly back down into the pit. The carriage shown is pictorial in nature only and is intended only to depict the means of translating motion from that of the drive into a into a useable means to eject the controller assembly from the pit and replace it.

The attachment linkage is a quick release pin that ultimately connects the carriage to the controller assembly enclosure. This pin lifts and holds the controller assembly as it travels yet allows the controller assembly to rotate about the pin. In this manner the carriage is able to lift the controller assembly vertically, thereby ejecting it from the escalator pit, yet still allow the controller assembly to pivot from vertical to horizontal so that service may be performed upon it. With the pin being quick release, the controller assembly can easily be disconnected from the carriage assembly for manual removal of the controller assembly in the event of automatic ejector malfunction or loss of power. The linkage pin is representative of a quick release attachment system that allows the carriage to easily connect and disconnect from the controller assembly. It is not intended to be the only method of attachment.

The optional automatic pivoter is a linkage that is activated according to the location of the carriage and controller assembly as they travel up and down the guide tube. As the controller assembly approaches the upper end of travel the automatic pivoter arms rotate upward engaging the controller assembly and automatically rotate the controller assembly from vertical to horizontal. Likewise, as the carriage travels downward the automatic pivoter arms are free to retract and are forced to do so by the weight of the controller assembly, thereby allowing the controller assembly to return to the vertical position. The automatic pivoting means shown in the present invention is intended as a sample and is not intended to be restricted to that form only. Other forms of automatic pivot can be used such as cam operated, electric operated or other operation.

The optional latch with manual release is available in place of the automatic pivoter to retain the controller assembly in a vertical position until the service technician is ready to manually release it from the vertical position and allow it to rotate to horizontal after ejection, with his assistance. This option is especially useful in tight space configurations where automatic pivot may not be practical to use. The latch with manual release shown is typical and is not intended to be restrictive in nature as to the type of latch and release used.

An additional configuration for operation of the automatic ejector is to have the controller assembly rotated 180 degrees from its conventional orientation. Conventional orientation of an escalator controller assembly is its back to the wall of the pit and the front, where the door is, facing the interior of the pit. In this new reversed mode upon being vertically ejected the controller assembly is now facing the service technician who can then simply open the door.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DETAILED DESCRIPTION

Figure 1:
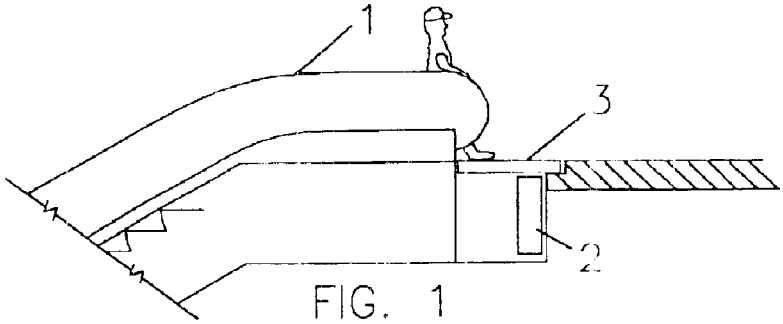
FIG. 1 is a side view of the upper portion of an escalator.

On referring to the drawings in detail, and in particular to FIG. 1, a side view of an upper portion of an escalator 1, which has its controller assembly 2 contained in the upper pit and covered by the escalator floor plate 3.

Figure 2:
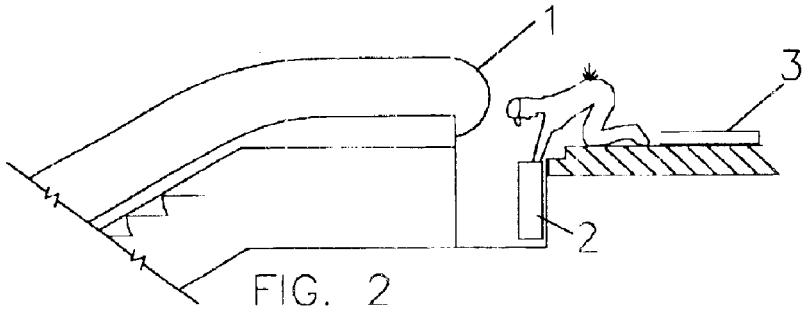
FIG. 2 is a side view of the upper portion of an escalator showing conventional means (manually) for removal of the controller assembly from the upper pit.

FIG. 2 is also a side view of an upper portion of an escalator 1 showing the escalator floor plate 3 removed for access to the pit and removal of the controller assembly 2, as it is currently removed by human power.

Figure 3:
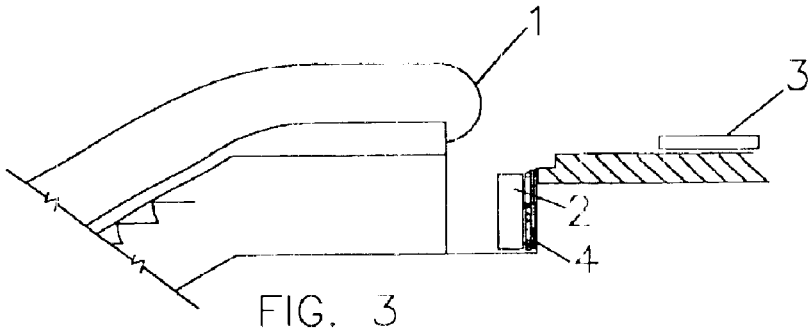
FIG. 3 is a side view of the upper portion of an escalator showing the automatic ejector mounted in the upper pit.

FIG. 3 is also a side view of an upper portion of an escalator 1 showing the automatic ejector 4 installed against the pit wall, the escalator floor plate 3 removed and the controller assembly 2 retained within the pit.

Figure 4:
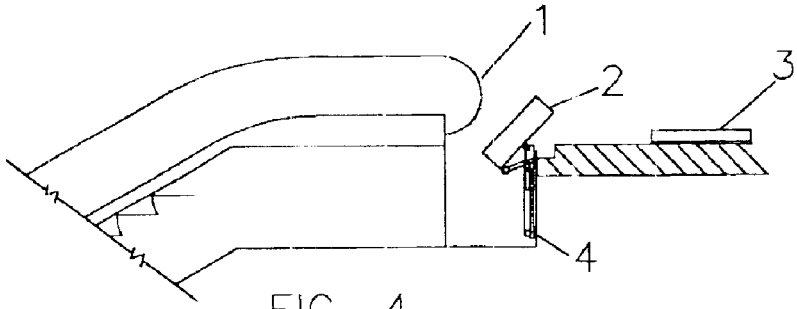
FIG. 4 is a side view of the upper portion of an escalator showing the controller assembly partially removed from the pit through the use of the automatic ejector.

FIG. 4 is also a side view of an upper portion of an escalator 1 showing the automatic ejector 4 installed against the pit wall, the escalator floor plate 3 removed and the controller assembly 2 partially ejected from the pit by the automatic ejector 4.

Figure 5:
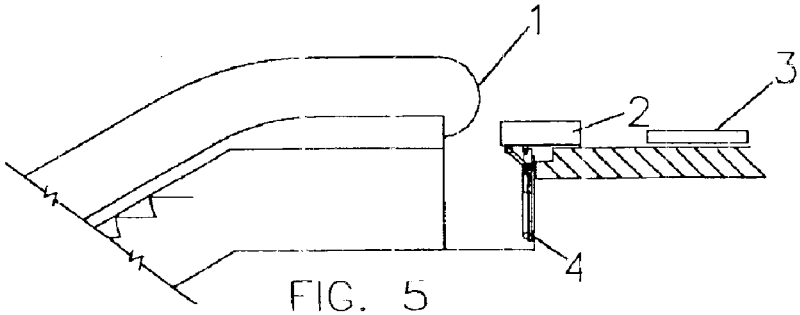
FIG. 5 is a side view of the upper portion of an escalator showing the controller assembly fully removed from the pit through the use of the automatic ejector.

FIG. 5 is also a side view of an upper portion of an escalator 1 showing the automatic ejector 4 installed against the pit wall, the escalator floor plate removed 3 and the controller assembly 2 fully ejected from the pit by the automatic ejector 4.

Figure 6:
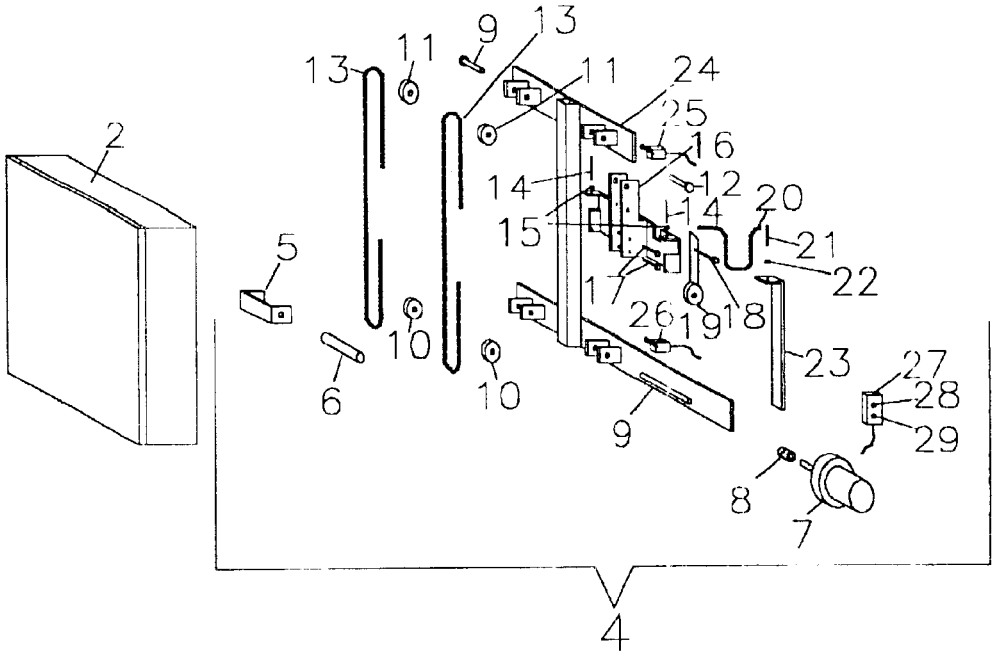
FIG. 6 is an exploded perspective view of the automatic ejector showing the individual components.

FIG. 6 is an exploded perspective of the controller assembly 2 and the automatic ejector 4 itself, which consists of the controller assembly attachment bracket 5, a device used to attach the controller assembly 2 to the automatic ejector carriage 16 through the insertion of the main attachment pin 6, a shaft that retains the controller assembly 2 to movement in the vertical plane, along with rotational movement about the main attachment pin 6 center of axis. The automatic ejector carriage 16 travels up and down the vertical plane and is guided by the automatic ejector mounting base/guide tube 24, which is rigidly attached to the escalator 1. The automatic ejector carriage 16 is retained to the automatic ejector mounting base/guide tube 24 by insertion of the carriage retainer pin 17 after the automatic ejector carriage 16 is positioned properly around the automatic ejector mounting base/guide tube 24. The carriage retainer pin 17 may be removed and replaced as needed to service portions of the automatic ejector 4. Also attached to the automatic ejector mounting base/guide tube 24 is a return sprocket axle 12, which supports the return sprocket 11, allowing it to rotate. Also supported by the automatic ejector mounting base/guide tube 24, is the drive shaft 9, which is helped to be contained in place by the automatic ejector mounting base/guide tube 24, but is free to rotate to turn the drive sprocket 10. Also attached to the drive shaft 9 is the drive coupling 8, which in turn is connected to the automatic ejector drive motor 7. The automatic ejector drive motor 7 is securely mounted to the automatic ejector mounting base/guide tube 24 and is of adequate size and capacity, that when combined with the drive sprocket 10, results in sufficient power to adequately eject and replace the controller assembly 2.

As seen in FIG. 6, the drive chain 13 is wrapped around the drive sprocket 10 and the return sprocket 11. Each end of the drive chain 13 is secured to the automatic ejector carriage 16, with one end being connected directly to the automatic ejector carriage 16 itself and the other end being secured to the drive chain adjusting rod 14, a threaded rod that is then threaded into the automatic ejector carriage 16 and once adjusted for proper drive chain 13 tension, is secured in place by the drive chain adjusting rod lock nut 15.

As is also seen in FIG. 6, the automatic pivoter bracket 23 is rigidly attached to the automatic ejector mounting base/guide tube 24. Attached to the automatic pivoter bracket 23 is the automatic pivoter chain adjusting rod 21, which is a threaded rod that threads into the automatic pivoter bracket 23. The purpose of the automatic pivoter chain adjusting rod 21 is to adjust the automatic pivoter chain 20 to the proper tension. Once adjusted, the automatic pivoter chain adjusting rod 21 is held in place by the automatic pivoter adjusting rod lock nut 22. The other end of the automatic pivoter chain adjusting rod 21 is connected to the automatic pivoter chain 20, which has its other end connected to the automatic pivoter arm 19. The automatic pivoter arm 19 pivots around the automatic pivoter axle 18, which is securely attached to the automatic ejector carriage 16. By having one end of the automatic pivoter chain 20 stationary by virtue of connection to the automatic pivoter bracket 23 and having the other end travel with the automatic ejector carriage 16, the automatic pivoter chain 20 will become tight prior to the automatic ejector carriage 16 reaching its limit of travel in the up direction, which is the direction of travel to eject the controller assembly 2. Once the automatic pivoter chain 20 becomes tight, the automatic pivoter arm 19 will rotate engaging the controller assembly 2 causing the controller assembly 2 to rotate from its stored vertical position to the ejected horizontal position as it approaches the upper end of travel.

Figure 11:
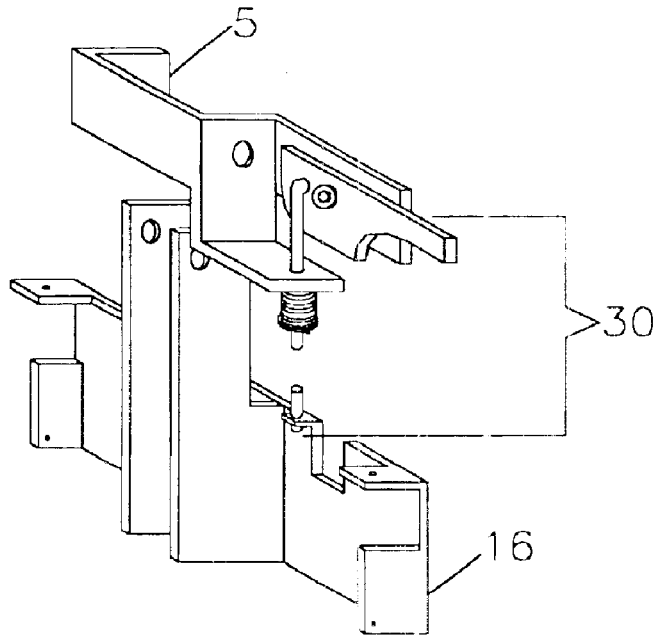
FIG. 11 is a view of the latch and manual release for use with the automatic ejector in place of the automatic pivoter.

It should be noted as shown in FIG. 11 that an optional latch and manual release 30 can be used in place of the automatic pivoter bracket 23, automatic pivoter chain adjusting rod 21, automatic pivoter adjusting rod lock nut 22, automatic pivoter chain 20, automatic pivoter arm 19 and automatic pivoter axle 18. This latch and manual release 30 is especially useful in configurations where the escalator 1 pit contains too many obstacles, preventing rotation of the controller assembly 2 from vertical to horizontal until it is fully ejected. Use of the latch and manual release 30 allows the controller assembly 2 to be retained and ejected in the vertical position from the escalator 1 pit, and then unlatched and manually pivoted after ejection under the care and control of the technician. Another optional configuration of the automatic ejector 4 is to have the controller assembly 2 rotated 180 degrees from that as shown in FIG. 6 so that the controller assembly 2 door is facing away from the center of the escalator 1 pit instead of towards it. In this orientation the technician can leave the controller assembly 2 in an ejected vertical position and simply open its door to access the contents inside. Modification of the controller assembly attachment bracket 5, main attachment pin 6 and automatic ejector carriage 16 would allow this configuration.

Figure 7:
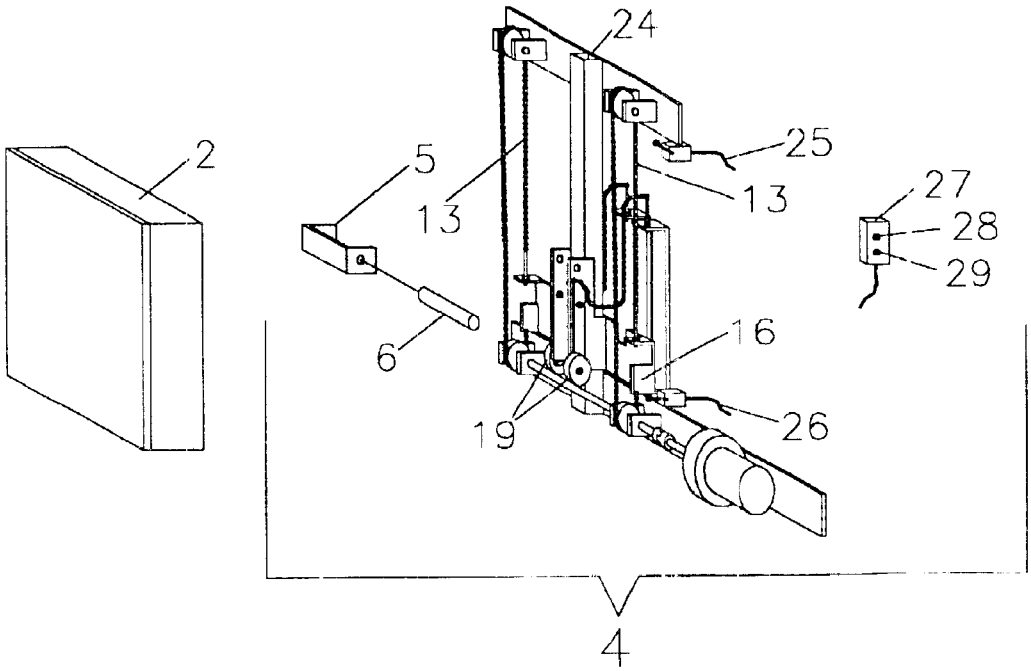
FIG. 7 is a perspective of the automatic ejector with the carriage lowered.

FIG. 7 is a perspective view of the automatic ejector 4 and controller assembly 2 with partial disassembly for clarity. FIG. 7 shows the automatic ejector carriage 16 in the lowered position, with the controller assembly 2 in its stored vertical position. For reference and clarity some of the more recognizable items such as the controller assembly attachment bracket 5, the main attachment pin 6, the automatic pivoter arm 19, the drive chain 13, the automatic ejector mounting base/guide tube 24, the up travel limit switch 25, the automatic ejector carriage 16, the pushbutton station 27, the up pushbutton 28 and the down pushbutton 29 are also noted.

Figure 8:
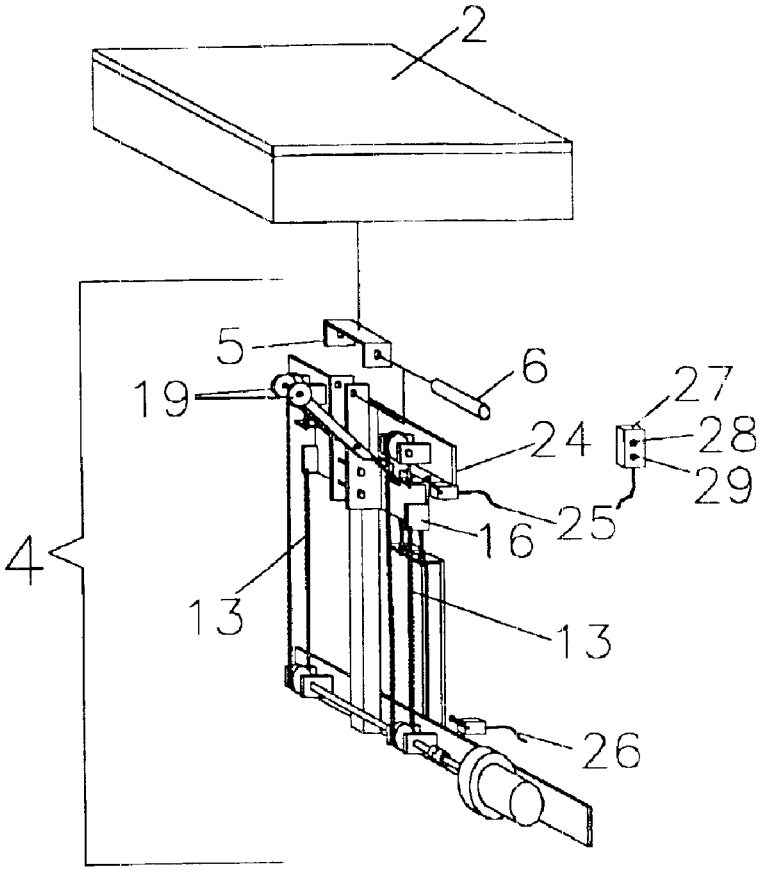
FIG. 8 is a perspective of the automatic ejector with the carriage raised.

FIG. 8 is a perspective view of the automatic ejector 4 and controller assembly 2 with partial disassembly for clarity. FIG. 8 shows the automatic ejector carriage 16 in the raised position, which is with the controller assembly 2 ejected and rotated to the horizontal position. For reference and clarity some of the more recognizable items such as the controller assembly 2, the controller assembly attachment bracket 5, the main attachment pin 6, the automatic pivoter arm 19, the drive chain 13, the automatic ejector mounting base/guide tube 24, the up travel limit switch 25, the automatic ejector carriage 16, the pushbutton station 27, the up pushbutton 28 and down pushbutton 29 are also noted.

Figure 9:
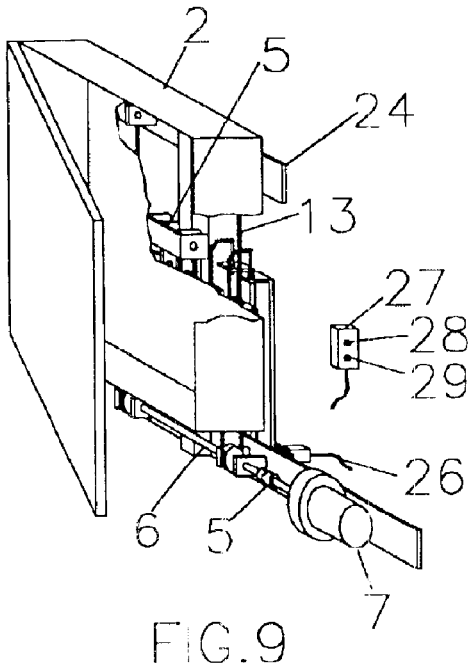
FIG. 9 is a cross-sectional perspective of the automatic ejector with the controller assembly attached.

FIG. 9 is a perspective view of the automatic ejector 4 and controller assembly 2 with the controller assembly 2 connected to the automatic ejector 4. For assistance in viewing, the controller assembly 2 is partially cut away. This is in order to show the controller assembly 2 in reference to the automatic ejector 4 when the controller assembly 2 is mounted to the automatic ejector 4 and the controller assembly 2 is retracted and in its stored vertical position. For reference and clarity some of the more recognizable items such as the controller assembly 2, the controller assembly attachment bracket 5, the drive chain 13, the automatic ejector mounting base/guide tube 24, the pushbutton station 27, the up pushbutton 28, the down pushbutton 29, the drive shaft 9, the drive coupling 8, the automatic ejector drive motor 7 and the down travel limit switch 26 are also noted.

Figure 10:
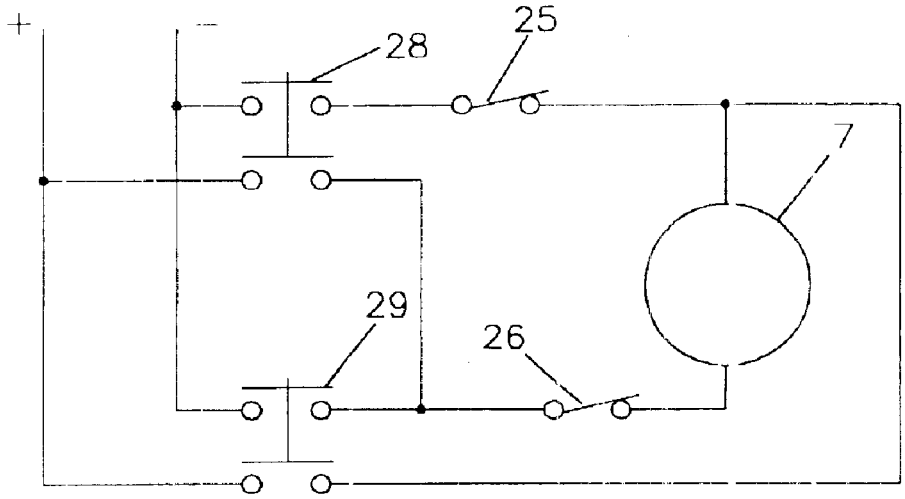
FIG. 10 is an electrical schematic showing one possible control operation of the automatic ejector.

FIG. 10 is an electrical ladder schematic showing one possible configuration of how the automatic ejector drive motor 7, the up pushbutton 28, the up travel limit switch 25, the down pushbutton 29 and the down travel limit switch 26 can be wired together to initiate proper operation of the automatic ejector 4.

As seen from the figures the sequence of operation of the automatic ejector 4 is to begin from rest with the controller assembly 2 stored inside the escalator 1 pit in a vertical position and covered by the escalator floor plate 3. After removal of the escalator floor plate 3, the technician then pushes the up pushbutton 28. The up pushbutton 28 and down pushbutton 29 are both mounted securely within the pushbutton station 27, which is securely mounted to the escalator 1 in the pit and in close proximity to the automatic ejector 4. Pushing the up pushbutton 28 sends the up signal to the automatic ejector drive motor 7, which begins its rotation and in turn begins rotating the drive coupling 8 and drive shaft 9. The drive sprocket 10, being securely attached to the drive shaft 9 begins to rotate as well, moving the drive chain 13 causing the automatic ejector carriage 16 to rise and begin ejecting the controller assembly 2. As the automatic ejector carriage 16 approaches the upper limit of travel, the automatic pivoter chain 20 becomes tight causing the automatic pivoter arm 19 to rotate, causing the controller assembly to rotate from its stored vertical position, to its ejected horizontal position. Upon completion of rotation the automatic ejector carriage 16 contacts and trips the up travel limit switch 25 causing the automatic ejector drive motor 7 to shut off and in turn stopping the controller assembly 2 in the ejected, horizontal position. The up travel limit switch 25 is connected to the automatic ejector mounting base/guide tube 24 and is adjustable for differing vertical rises. Retraction and storage of the controller assembly 2 is then accomplished by the technician pushing the down pushbutton 29, which causes the automatic ejector drive motor 7 to receive a down signal and begin rotation of the automatic ejector drive motor 7, the drive coupling 8, the drive shaft 9, and the drive sprocket 10 in the opposite rotation of the ejection process. This in turn causes the drive chain 13 to move causing the automatic ejector carriage 16 to travel down and begin retracting the controller assembly 2 into the pit of the escalator 1. As the automatic ejector carriage 16 travels down, the automatic pivoter chain 20 becomes slack and the controller assembly 2 weight causes it to pivot back into its stored vertical position. The automatic ejector carriage 16 continues to travel downward until it trips the down travel limit switch 26, which shuts off the automatic ejector drive motor 7 and brings the automatic ejector carriage 16 to rest with the controller assembly in its stored position.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A device for automatically removing a controller assembly from an escalator pit to eliminate the risk of human injury, the device comprising:

a mounting base having upper and lower portions for attaching to an escalator pit wall, a guide attached to and between the upper and lower portions of the mounting base, drive sprockets secured at the lower portion of the mounting base, return sprockets secured at the upper portion of the mounting base, a drive motor, drive coupling, and drive shaft operably connected to the drive sprockets, an ejector carriage which rides vertically up and down along the guide, wherein the carriage is connected on each side to a respective drive chain, whereby the ejector carriage travels from a vertical stored position to an ejected horizontal position, drive chains connected between the drive sprockets and return sprockets, wherein one end of each drive chain is connected to a threaded adjusting rod, which is connected to said carriage and the other end of each chain is connected directly to the carriage, an automatic pivoter arm and bracket for pivoting around a pivoter axle via an automatic pivoter chain, wherein the pivoter axle is securely attached to the ejector carriage and upon the carriage reaching its uppermost vertical position, the pivoter chain tightens causing the pivoter arm to rotate along with the ejector carriage and move the carriage to said ejected horizontal position out of the escalator pit, and;

a push button station for controlling the automatic movement of the ejector carriage, wherein an up travel limit switch and a down travel limit switch interact with said push button station to control movement of the ejector carriage from the stored vertical position to the ejected horizontal position.

2. The device of claim 1, wherein the rotational power of the drive sprockets causes a linear movement of the ejector carriage.

3. The device of claim 1, wherein the threaded adjusting rod further includes a lock nut to further tension the drive chain.

4. The device of claim 1, wherein a manual latch and release mechanism can be substituted for the automatic pivoter arm and bracket when space in the escalator pit does not allow for the ejector carriage to rotate from the vertical to the horizontal position.

5. A method of automatically removing a controller from an escalator pit without the the use of manpower utilizing the device of claim 1, in order to eliminate the risk of human injury during the maintenance or repair of an escalator controller, the method comprising:

removing an escalator floor plate to expose a controller of an escalator, attaching the device of claim 1 to a vertical wall of the escalator pit with the controller of the escalator attached to the ejector carriage, operating an up push button in the push button station causing the automatic pivoter chain to tighten in order to move the controller of the escalator from a stored vertical position to a horizontal ejected position so that maintenance or repair work can be performed on the controller, and;

returning the controller to its stored vertical position after the work has been performed by engaging a down pushbutton which causes the automatic pivoter chain to become slack and the controller to move down into the escalator pit with the ejector carriage.

* * * * *